United States Patent [19]

King

[11] Patent Number: 4,892,235

[45] Date of Patent: Jan. 9, 1990

[54] JOINT AND SHROUD SUPPORT FOR POUR TUBE AND COLLECTOR NOZZLE

[75] Inventor: Patrick D. King, Rantoul, Ill.

[73] Assignee: Flo-Con Systems, Inc., Champaign, Ill.

[21] Appl. No.: 210,577

[22] Filed: Jun. 23, 1988

[51] Int. Cl.[4] ..... B22D 37/00

[52] U.S. Cl. ..... 222/607; 222/600

[58] Field of Search ..... 222/591, 594, 600, 606, 222/607; 266/236, 287

[56] References Cited

U.S. PATENT DOCUMENTS

| | | | |
|---|---|---|---|
| 4,063,668 | 12/1977 | Shapland et al. | 222/600 |
| 4,415,103 | 11/1983 | Shapland et al. | 222/600 |
| 4,526,304 | 7/1985 | Nishimura | 222/607 |
| 4,555,050 | 11/1985 | Schiefer et al. | 222/606 |
| 4,593,838 | 6/1986 | Oberbach et al. | 222/607 |

FOREIGN PATENT DOCUMENTS

| | | | |
|---|---|---|---|
| 106823 | 4/1984 | European Pat. Off. | 222/606 |
| 2153977 | 8/1985 | United Kingdom . | |
| 2171348 | 8/1986 | United Kingdom | 222/607 |

*Primary Examiner*—Robert McDowell

*Attorney, Agent, or Firm*—Jack E. Dominik

[57] ABSTRACT

A shroud or submerged pour tube which has a sealing cup of an essentially frustoconical configuration at its upper end is disclosed. The sealing cup matingly engages a bullet-shaped nose on the lower portion of the collector nozzle extending downwardly from the valve. The combination of the collector nozzle and the shroud and the joint are held in compressive and oriented relationship by a shroud support assembly. The shroud support assembly has adjustable length arms to permit tilting the shroud axis for alignment at the lower end of the shroud. This urges a line contact at the joint at the upper end of the shroud where it engages the bullet nose of the collector nozzle. The support assembly also may be mounted with flexibility for moving on the XY axis where the Z axis is the axis of the pour tube or shroud in those two plate situations where the collector nozzle shifts laterally during the on and off condition and also during throttling.

3 Claims, 3 Drawing Sheets

JOINT AND SHROUD SUPPORT FOR POUR TUBE AND COLLECTOR NOZZLE

FIELD OF THE INVENTION

The present invention relates primarily to the teeming of metal. More specifically it relates to the utilization of valves, usually bottom pour valves, employed in such teeming. The valve can be mounted on a tundish or a ladle. The specific function of the invention is directed to a pour tube which is primarily submerged, and the mechanism for mounting the same to a depending collector nozzle on the valve, and a joint construction in the shroud or submerged pour tube for coupling the same to the collector nozzle of the valve.

SUMMARY OF THE PRIOR ART

The prior art includes several types of teeming valves for metal. A well-known construction is exemplified in applicant's assignee's U.S. Pat. No. 4,063,668 issued Dec. 20, 1977. A further application and more specific application appears in the Shapland and King patent relating to a tundish valve, U.S. Pat. No. 4,415,103 issued Nov. 15, 1983.

In connection with the use of such valves, initially the teeming of the metal was accomplished in an open stream. If the stream depended from a tundish it was used in billet casting or continuous casting. Where ladles were employed the stream primarily was directed to a tundish for continuous pour, or to an ingot for the preparation of ingots.

With advancing quality control in the making of steel, submerged pouring and teeming is becoming the rule rather than the exception. In these instances normally there is a shroud or a submerged pour tube which is coupled to the valve, irrespective of whether its a ladle valve or a tundish valve. The shroud or submerged pour tube, in turn, extends downwardly into the area in which teeming is taking place. For example, if teeming is going directly from a tundish into a continuous caster mold, the shroud or submerged pour tube actually extends within the liquid metal portion of the mold and the metal is poured through the shroud orifice directly into the mold and isolated from ambient environment. When being poured from a ladle even into a tundish, the shroud or submerged pour tube is thrust downwardly into the metal in the tundish to thereby isolate the teeming melt from ambient.

When pouring from a ladle into a tundish orienting the lower portion of the shroud or submerged pour tube may not be critical. On the other hand, when smaller pouring forms are used, smaller billets are used, smaller ingots are used, or even a smaller continuous casting mold, the orientation of the lower portion of the shroud or submerged pour tube becomes more critical. Furthermore, the joint between the upper portion of the shroud or pour tube with the depending collector nozzle of the valve requires a good seal which excludes ambient air at that point since venturi-like effect can exist at the coupling, and ambient air may be sucked into the shroud tube. The invention is directed, therefore, to the mechanism, apparatus, construction of the shroud or submerged pour tube, construction of the collector nozzle of the valve, and the joint between the collector nozzle and the pour tube.

SUMMARY OF THE INVENTION

The invention is directed to a shroud or submerged pour tube which has a sealing cup of an essentially frustoconical configuration at its upper end. The sealing cup matingly engages a bullet-shaped nose on the lower portion of the collector nozzle extending downwardly from the valve. The combination of the collector nozzle and the shroud and the joint are held in compressive and oriented relationship by a shroud support assembly. The shroud support assembly has adjustable length arms to permit tilting the shroud axis for alignment at the lower end of the shroud. This urges a line contact at the joint at the upper end of the shroud where it engages the bullet nose of the collector nozzle. The support assembly also may be mounted with flexibility for moving on the XY axis where the Z axis is the axis of the pour tube or shroud in those two plate situations where the collector nozzle shifts laterally during the on and off condition and also during throttling.

In view of the foregoing it is a principle object of the present invention to provide a joint between a shroud or submerged pour tube and a collector nozzle of a teeming valve which accommodates adjustments in the axial orientation of the submerged pour tube.

Another object of the present invention is directed to mounting means for such a shroud or submerged pour tube which permits adjustability of the lower end portion of the shroud, and freedom of mobility to accommodate a shifting situation with the valve collector nozzle.

Still another and critical object of the present invention is to provide a joint between the collector nozzle of a valve and the upper portion of a shroud or submerged pour tube which will accommodate angular variations, and lateral shifting, while yet maintaining line contact to seal the area against the ingress of ambient air.

BRIEF DESCRIPTION OF THE DRAWINGS

Further objects and advantages of the present invention will become apparent as the following description proceeds, taken in conjunction with the accompanying drawings, in which.

DESCRIPTION OF PREFERRED EMBODIMENTS Valve Construction

Figure 2:
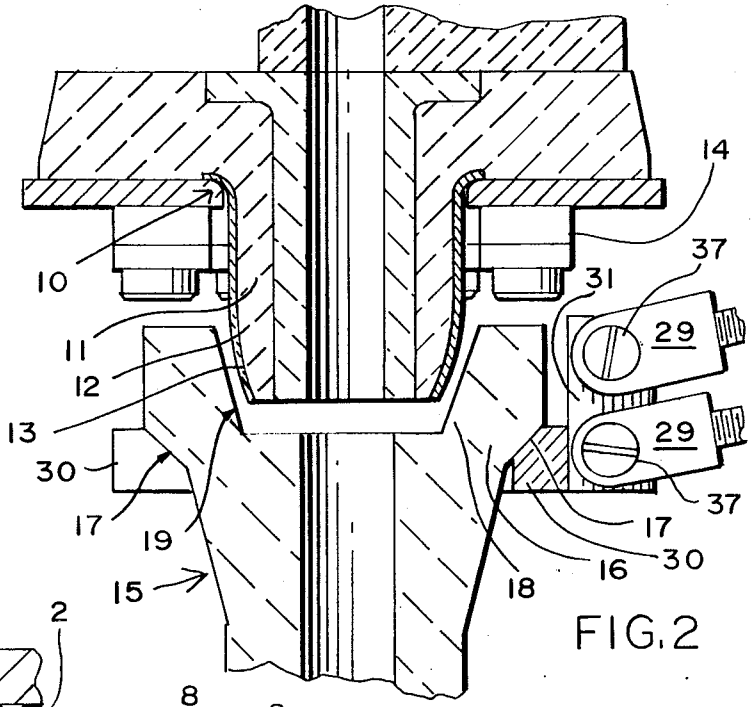
FIG. 2 is an enlarged view of the connection joint between the upper end of the shroud and the lower end of the tube holder showing the shroud disengaged from the tube holder.

The subject valve 3 is secured to the vessel shell 1 by means of a mounting plate 2. Extending from the interior of the vessel to the upper refractory of the valve is a well block nozzle 4. The well block nozzle and its teeming orifice 5 in turn, is positioned above the upper stationary plate 6. The stationary plate 6, in turn, has beneath it the slide gate 7 which is activated in and out of position by means of slide gate drive 8. The slide plate 7 cannot only move in and out of register from a teeming to a non-teeming configuration, but it can be shifted laterally in order to throttle the amount of teeming. Indeed, in one configuration the slide gate 7 shuts off laterally which permits the removal and replacement of the shroud 15 for immediate resumption of casting. The final plate in the "sandwich" is the tube holder 10 which is at the immediate lower portion of the slide gate 7. The tube holder 10 has a collector nozzle 11 lower portion. In this particular configuration, the collector nozzle lower portion has a rounded configuration or bullet-like nose 12 construction.

Figure 1:
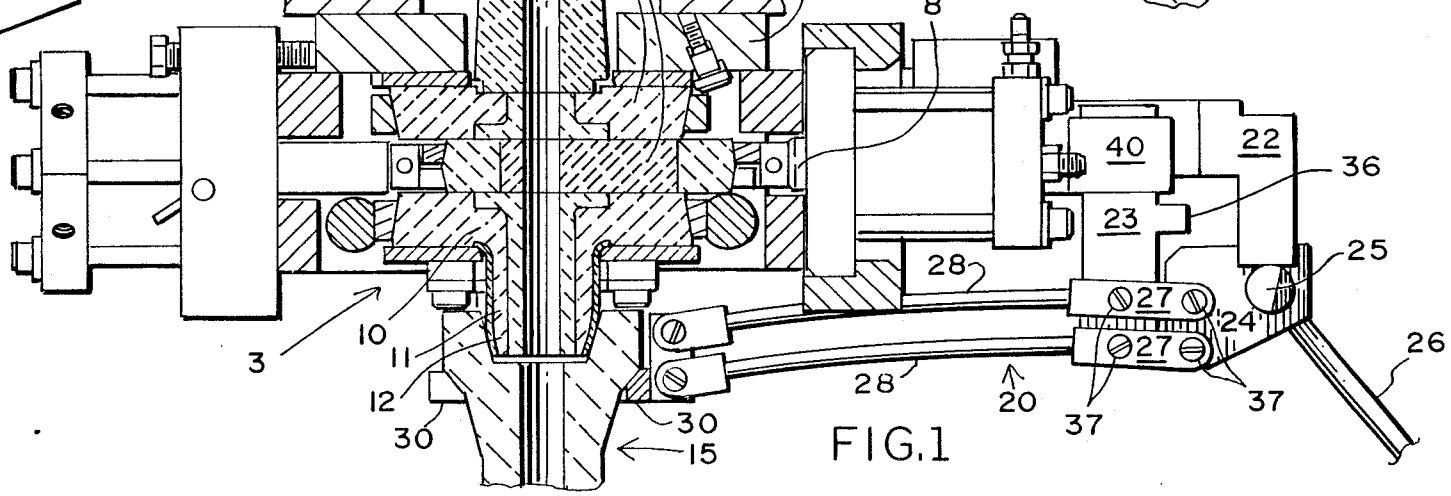
FIG. 1 discloses a transverse sectional view of a typical tundish valve utilizing a three plate system in which the bottom plate is a tube holder conformed for mating engagement with a shroud which, in turn, extends beneath the surface of the metal being teemed typically into a continuous caster mold.

The tube holder 10 and collector nozzle 11 with its bullet nose 12 encased in the metal encasement 13 are secured by means of a mounting assembly 14 to the sliding gate valve 3. They, in turn, connect with a shroud 15 as shown in FIGS. 1 and 2, which shroud has an upper end shroud head portion 16, and therebeneath a shroud support collar 17 which has a tapered or chamfered face 19. The tapered or chamfered face 19 is immediately above the shroud frustoconical sealing cup 18 provided in the shroud head 16.

Adjustable Support Assembly

The adjustable support assembly relies upon a mount assembly 20, coupled with a swing arm 21, and activated by a ground bar 22. Pivot block 23 is positioned beneath the swing arm 21 and is coupled to the drive block 24. The drive block 24, in turn, is actuated upwardly and downwardly by cam 25 which is rotated by means of the operating handle 26. Although, as will be seen in FIG. 2, the travel up and down of the drive block 24 is limited, it is magnefied as a second class lever as will be described.

The drive clevis 27 is secured to the arm beam 28, and the load clevis 29. At the far end of the load clevis 29, a shroud seat 30 is provided to engage the shroud or pouring tube as will be described hereinafter. A further load block 31 is positioned between the two parallel load clevises 29.

A left-hand thread 32 and right-hand thread 33 are on the ends of the arm beam 28, and coordinate with the upper control arm 34 and lower control arm 35 in order to lengthen or shorten the arm beam 28 to adjust the position desired for the shroud seat 30. Finally, a down stop 36 is provided to limit the degree to which the shroud seat 30 can swing downwardly.

Figure 3:
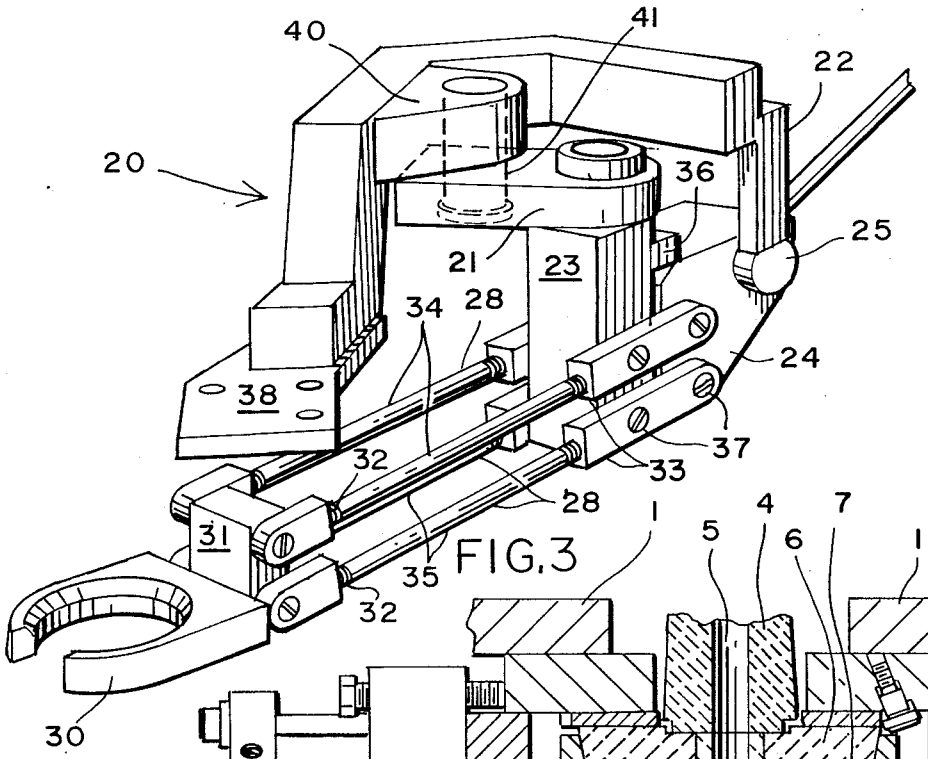
FIG. 3 is a partially diagrammatic perspective view of the tube holder which engages the collar at the upper portion of the shroud and raises and lowers the same into operative relationship with the three plate valve tube holder and also permits swinging the shroud after it disengages the shroud from the tube holder.

As noted particularly, in the perspective view of the shroud mount assembly 20 shown in FIG. 3, the shroud seat 30 is secured to a load block 31. The load block 31 is engaged by means of headers and threads in which there is a left-hand thread 32 and a right-hand thread 33 respectively on the upper control arm 34 and the lower control arm 35. In operation, provision is made (see particularly FIGS. 1 and 3) for a down stop 36 which terminates the downward movement of the shroud mount assembly to a level such as that illustrated in FIG. 2 where the shroud can be rotated and removed from its engagement with the collector nozzle 11 of the tube holder 10 for reinsertion, replacement, or total removal. The various elements providing the pivot for the pivot arm assembly of shroud mounting assembly 20 are secured by means of a plurality of pivot bolts 37 as shown. The mounting plate 38 is secured to the end of the shroud mounting assembly and more particularly the frame portion or spring arm 21.

Figure 4:
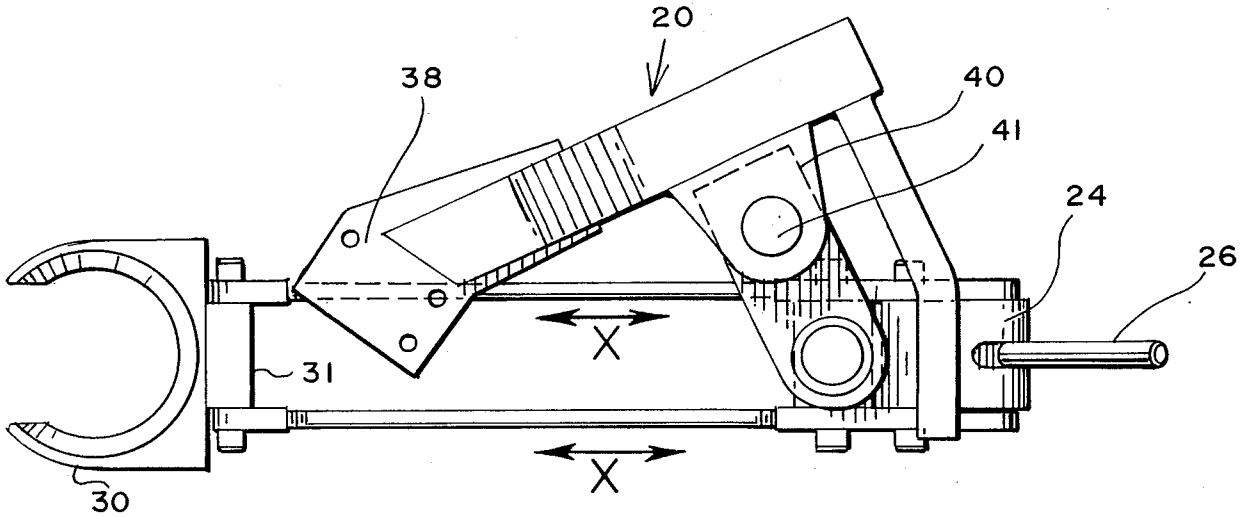
FIG. 4 is a plan view of the tube holder arm illustrating the relative motion in a swinging fashion of the tube holder support shroud seat.
Figure 5:
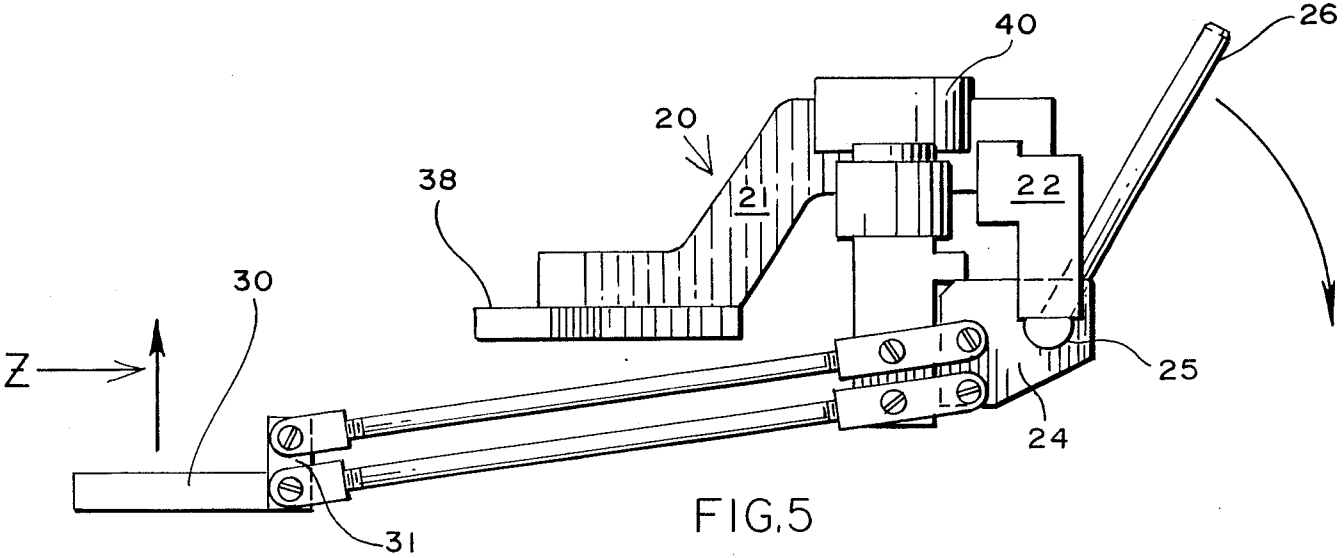
FIG. 5 is a front elevation of the tube holder support illustrating how the control arm moves in raise the shroud seat.
Figure 6:
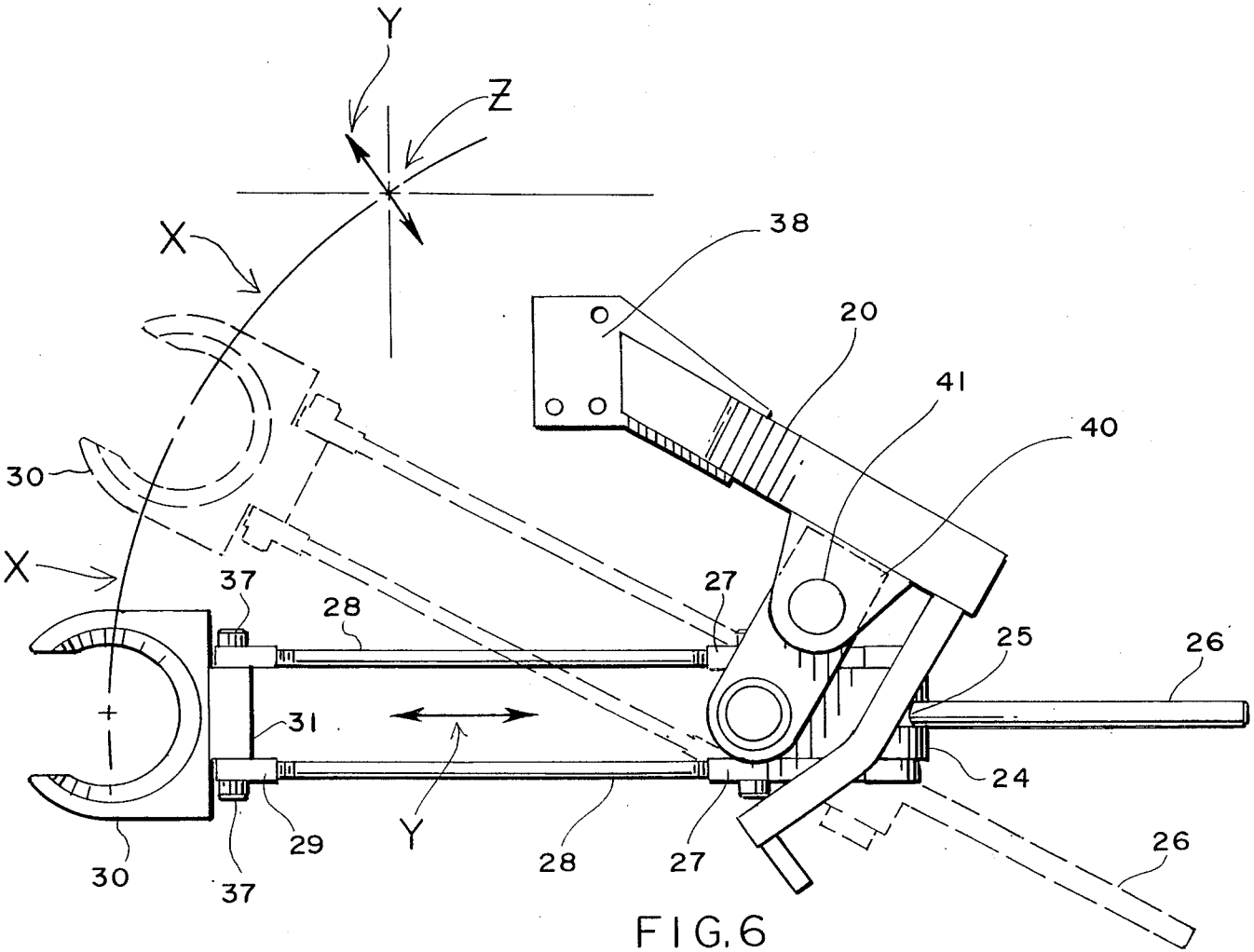
FIG. 6 is a plan view comparable to that show in FIG. 4, but illustrating two positions of the arm assembly and the orientation of the various axes of rotation and movement.

As noted particularly in FIG. 6, and also in FIG. 4, provision is made so that the pivot arms 34, 35 can be moved along what is shown as an X axis. This is achieved by providing a centering pivot mount 40 which extends immediately above the pivot block 23, and by means of centering pivot shaft 41 provided interiorly thereof permits the shifting of the entire assembly with the supported shroud along the axis shown as an X axis in the event the shroud and the collector nozzle are slightly out of position. This is normally accomplished prior to or at the time movement is made such as diagrammatically illustrated in FIG. 5 to shift the shroud seat 30 upwardly along the axis shown as the Z axis. Otherwise the remaining axis of movement is the X axis as shown in FIG. 6 which is the principal axis of rotation of the arm assemblies.

Shroud or Submerged Pour Tube Construction

The shroud 15 as shown in FIGS. 1 and 2, has a shroud head 16 at its upper portion and a shroud support collar 17 as a tapered lower face providing a shroud seat face 19 on the shroud 15 for engagement ith the shroud seat 30 of the swing arm assembly 20. Important to the entire construction is the frustoconical tube holder cup-like seat 18 at the upper portion of the shroud 15. The seat 18 has frustoconical sidewalls, and terminates in a lower annular shoulder which is proportioned to be slightly beneath the lower end of the collector nozzle 11 of the tube holder 10. Shrouds or tubes have varying configurations at their lower end portions. In some the lower end is a dead end, and the metal teems radially through orifices immediately above the closed lowered end. In other instances vertical slots are employed at the lower portion of the tube. The present invention is not directed to the lower end of the pouring tube or shroud, but presupposes that a wide variety of configurations can be employed so long as adequate drainage is provided to accommodate the desired teeming rate of the valve.

Joint Construction and Method for Accommodating Same

The joint construction at the joint between the tube holder 10 and the upper end of the shroud 15 is basically as described above. The shroud 15 has a frustoconical sealing cup 18 with sidewalls which are curvilinear only in one direction. This is to provide for tangential contact with the lower end bullet nose 12 of the tube holder 10 in which its lower bullet nose 12 is curvilinear in two directions. This bi-directional curvilinearity of the lower end of the tube holder collector permits line tangential contact between the tube holder bullet nose 12 and the frustoconical sealing cup 18 in the head 16 of the shroud 15 or collector. Thus the joint is almost self-sealing, and yet it insures a good seal despite dimensional changes which may occur during teeming, and which do occur from shroud to shroud and tube holder to tube holder.

Operation

In operation, the handle 26 is either raised, or lowered to position the shroud along its Z axis in contact with the tube holder, or drop it out of contact with the tube holder. Once dropped out of contact with the tube holder, the control arm 26, now in its up configuration as shown in FIG. 5, can be used to pivot the entire assembly around the pivot block 23 connection with the swing arm 21. This permits rotating the entire parallelogramic support member and therewith the shroud seat 30 which moves the shroud out of contact with the valve, and into a position where it can be removed from the shroud seat 30 and another shroud positioned within the seat. Once the new shroud is in position on the shroud seat 30, the swing arm supported pivot block 23 is rotated back into position where the shroud seat 30 and shroud are immediately beneath the tube holder portion of the valve. Thereafter, the operating handle 26 is lowered (see FIGS. 1 and 5), which permits the cam 25 to rotate against the ground bar 22, and raise the shroud seat 30 until the shroud is in its coupled relationship with the tube holder as illustrated in FIG. 1.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed is:

1. A combination shroud to slide gate collector nozzle joint for use in a sliding gate valve construction for teeming metal, such combination including bullet-shaped metal encased collector nozzle at the lower portion of said valve, a shroud formed of a refractory, said shroud having a body portion which is essentially tubular, said tubular body portion having a shroud orifice extending downwardly, an open end portion at the upper portion of said shroud, said open end portion having a refractory faced sealing cup with frustoconical sidewalls, said shroud having means at its upper end for receiving a support ring for urging said shroud in contact with a bullet-shaped nose of the collector nozzle.

2. A joint construction for a collector nozzle utilized in a sliding gate valve and a shroud with a submergible pour tube comprising, in combination, a bullet-shaped metal encased tapering nose portion at the lower end of a collector nozzle on the lower portion of the sliding gate valve, a frustoconical refractory faced sealing cup at the upper portion of the shroud with a submergible pour tube, said bullet-shaped collector nozzle nose and frustoconical sealing cup walls being proportioned for a mating metal to refractory fit at a mid-portion on the periphery of each, whereby the sealing cup may be tilted axially and its interior frustoconical walls self-aligning on the bullet-shaped nose of the collector nozzle to conform to a linear seal in various angular orientations of the shroud.

3. A support mechanism for a sliding gate valve for positioning a shroud in teeming relationship with a collector nozzle extending from the sliding gate valve comprising, in combination, a parallelogramic tube support level assembly, said parallelogramic assembly having at least two pairs or arm beams which are adjustable in length, said parallelogramic assembly having a load clevis and drive clevis adjacent each end secured fixedly at pivot points, a pivot block for the drive clevis and secured thereto, a shroud seat for the load clevis and secured thereto, drive means secured to actuate the drive clevis, said arm support and parallelogramic assembly being sufficiently flexible to permit the support means for the shroud to shift angularly, whereby said support assembly may secure a shroud to a collector nozzle on a sliding gate valve and permit the shroud to be positioned with its vertical axis shifted to orient the lower portion of the shroud in a position different than one coaxial with the teeming orifice of a sliding gate valve.

* * * * *